US010806971B1

(12) United States Patent
Michelin

(10) Patent No.: US 10,806,971 B1
(45) Date of Patent: Oct. 20, 2020

(54) NON-SPHERICAL GAME BALL AND METHOD OF USE

(71) Applicant: Lucas Michelin, New Castle, NH (US)

(72) Inventor: Lucas Michelin, New Castle, NH (US)

( * ) Notice: Subject to any disclaimer, the term of this patent is extended or adjusted under 35 U.S.C. 154(b) by 0 days.

(21) Appl. No.: 16/448,110

(22) Filed: Jun. 21, 2019

Related U.S. Application Data

(60) Provisional application No. 62/687,922, filed on Jun. 21, 2018.

(51) Int. Cl.
*A63B 43/00* (2006.01)
*A63B 39/00* (2006.01)

(52) U.S. Cl.
CPC ..... *A63B 43/002* (2013.01); *A63B 39/00* (2013.01)

(58) Field of Classification Search
CPC ..... A63B 43/002; A63B 39/00; A63B 39/08; A63B 37/00; A63B 43/02
USPC ..... 473/612; 273/146
See application file for complete search history.

(56) References Cited

U.S. PATENT DOCUMENTS 1,299,092 A * 4/1919 Abrahamson ..... A63B 43/002 473/595
1,644,466 A * 10/1927 Dewes ..... A63B 43/002 473/569
D140,084 S * 1/1945 Morris ..... D21/373
D235,358 S * 6/1975 Dufaud ..... D21/707
3,940,142 A * 2/1976 Hinz ..... A63F 9/0413 273/146
D373,603 S * 9/1996 Moradinia ..... D21/373
5,672,089 A * 9/1997 Piera Bermejo ..... A63B 37/00 40/327
6,003,470 A * 12/1999 Budman ..... A01K 15/025 119/711
D466,164 S * 11/2002 Bensimon ..... D21/373
D503,758 S * 4/2005 Crane ..... D21/707
D549,889 S * 8/2007 Winkler ..... D30/160
D563,486 S * 3/2008 Slater ..... D21/498
D682,361 S * 5/2013 Lander ..... D21/373
D688,893 S * 9/2013 Cornacchia ..... D6/665
D692,507 S * 10/2013 Meys ..... D21/498
8,756,894 B2 * 6/2014 Swartz ..... A63H 33/062 446/109
D771,750 S * 11/2016 Fjelstad ..... D21/373
D821,661 S * 6/2018 Burchman ..... D30/160
D869,561 S * 12/2019 Sladek ..... D21/373
2001/0015526 A1 * 8/2001 Dewa ..... A63F 9/0413 273/146

(Continued)

FOREIGN PATENT DOCUMENTS

CH 226042 A * 3/1943 ..... A63B 43/002
FR 2024019 A5 * 8/1970 ..... A63B 37/0098

*Primary Examiner* — Steven B Wong
(74) *Attorney, Agent, or Firm* — Ellenoff Grossman & Schole LLP; James M. Smedley; Alex Korona

(57) ABSTRACT

A non-spherical ball includes a plurality of shaped components secured together and forming a body of the non-spherical ball; a cylindrical exterior shape extending around a first axis of the body; a cube exterior shape extending around a second axis of the body; the cylindrical exterior shape and the cube shape intersect at a right angle; and the cube exterior shape minimizes roll of the non-spherical ball when thrown on the second axis; and the cylindrical exterior shape maximizes roll of the non-spherical ball when thrown on the first axis.

6 Claims, 8 Drawing Sheets

(56) References Cited

U.S. PATENT DOCUMENTS

| | | | | |
|---|---|---|---|---|
| 2008/0125235 | A1* | 5/2008 | Robledo | A63B 43/002 473/52 |
| 2015/0246266 | A1* | 9/2015 | Zawitz | A63B 43/06 473/570 |
| 2016/0325166 | A1* | 11/2016 | Wallace | A63B 69/0071 |

* cited by examiner

NON-SPHERICAL GAME BALL AND METHOD OF USE

BACKGROUND

1. Field of the Invention

The present invention relates generally to balls, such as used for games and recreational activities, and more specifically to a ball that includes both a cylindrical exterior edge and a cube exterior edge to allow the user to adjust how the ball rolls based on the user's throw.

2. Description of Related Art

Balls for use in games and recreational activities are well known in the art and include items such as footballs, basketballs, tennis balls, and the like. These items are commonly used for a particular sport and therefore include a very particular shape that is suitable for the sport. For example, a football is an oblong shape that is configured to fly through the air well, whereas a soccer ball is round, thereby allowing for the ball to roll easily.

One of the problems commonly associated with conventional balls is limited use. It is an object of the present invention to provide a ball that includes both a cylindrical exterior surface and a cubical exterior surface, along with a plurality of grips, thereby allowing for the user to throw, roll, and grip the ball as needed and desired for recreational activities.

Accordingly, although great strides have been made in the area of balls for sports and recreational use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
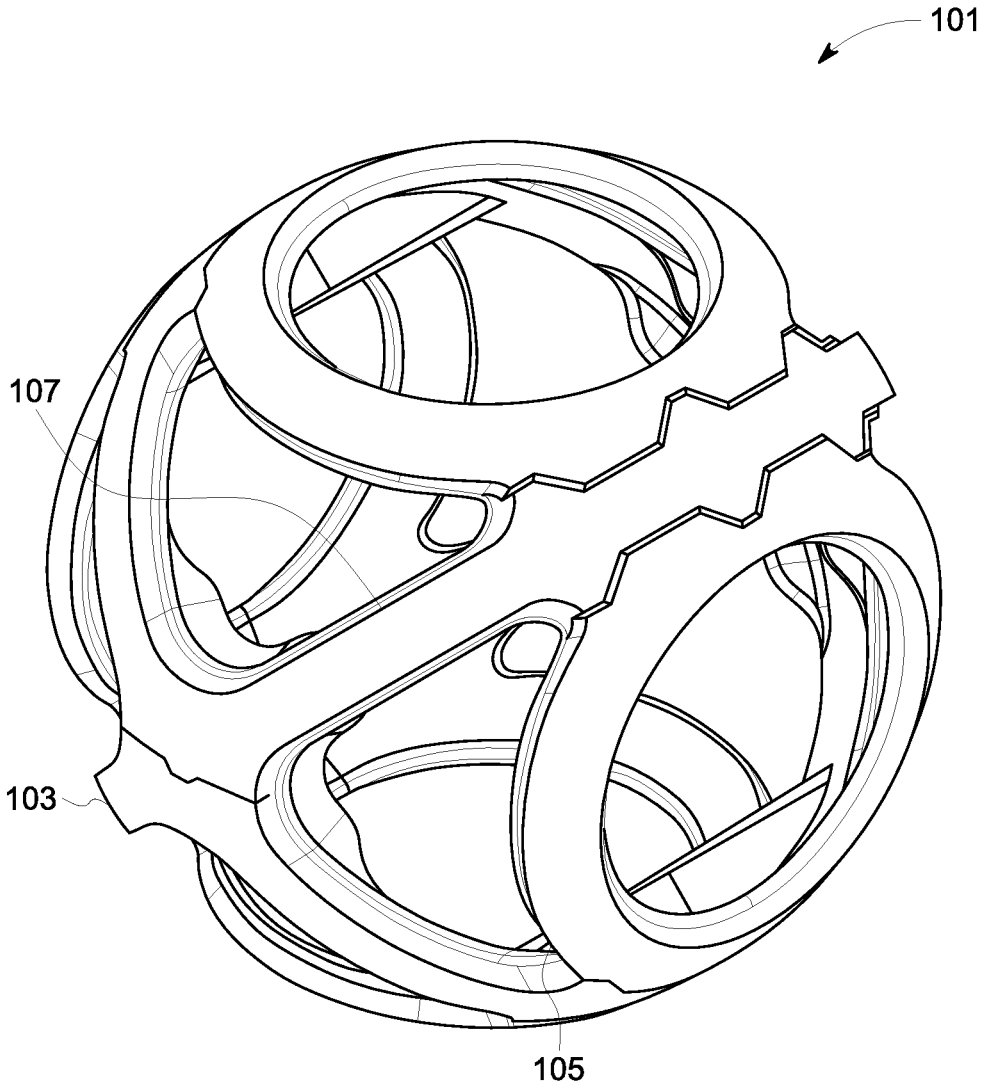
FIG. 1 is an isometric view of a ball in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional balls. Specifically, the present invention provides for a ball with a plurality of gripping locations and having different shapes, thereby providing for multiple uses of the ball. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-4 depict various views of a ball 101 in accordance with a preferred embodiment of the present application.

Figure 3:
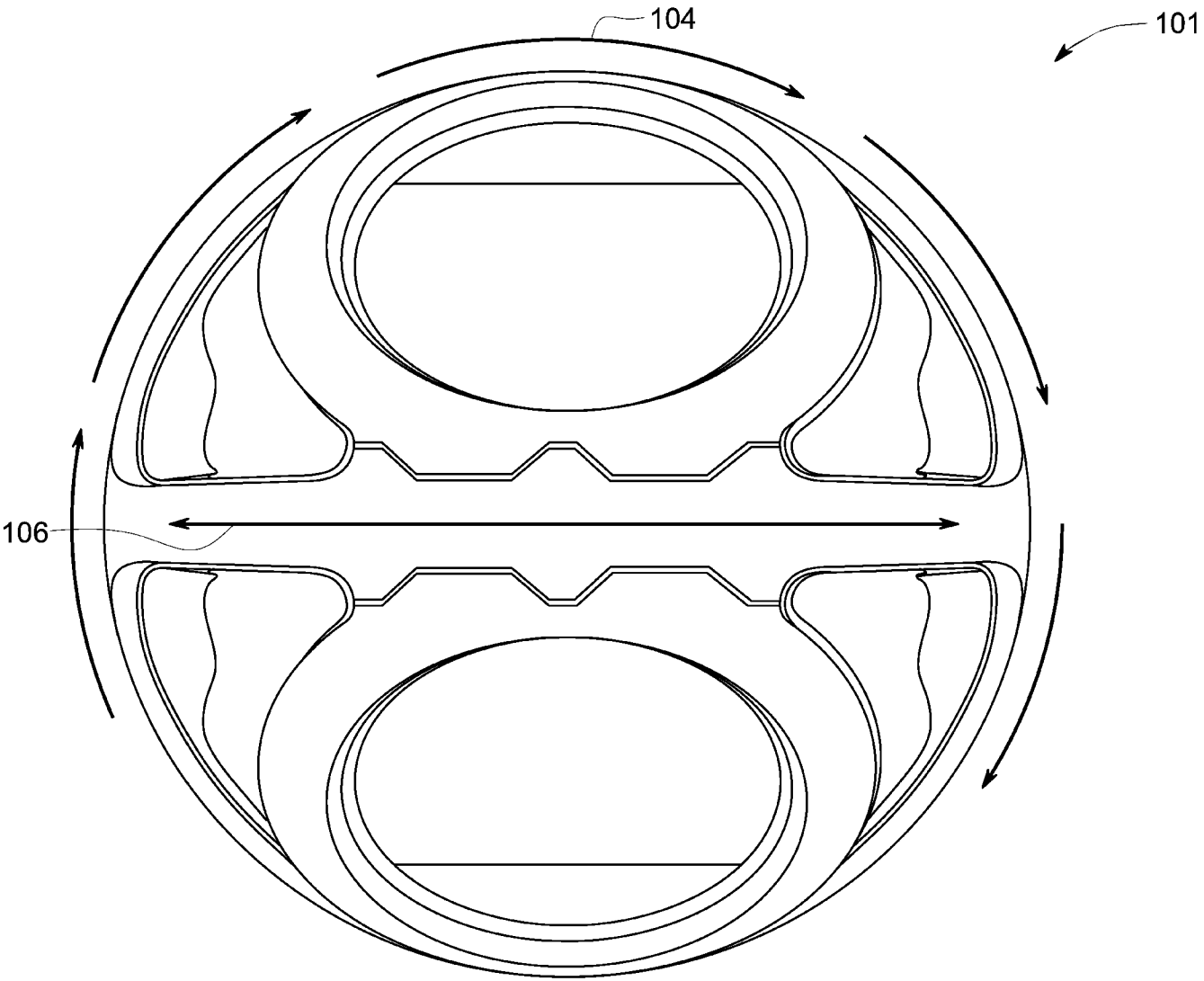
FIG. 3 is a second end view of the ball of FIG. 1.

In the contemplated embodiment, ball 101 includes a plurality of shaped components 103, 105, 107 secured together to form the body of the ball. In the preferred embodiment, the plurality of shaped components 103, 105, 107 are attached such that the ball includes a cylindrical exterior shape 104, 106, as shown in FIG. 3, and further includes a cube exterior shape 302 that travels a second axis of the body. In the preferred embodiment, the axis of the cube exterior shape and the axis of the cylindrical exterior shape intersect.

Figure 2:
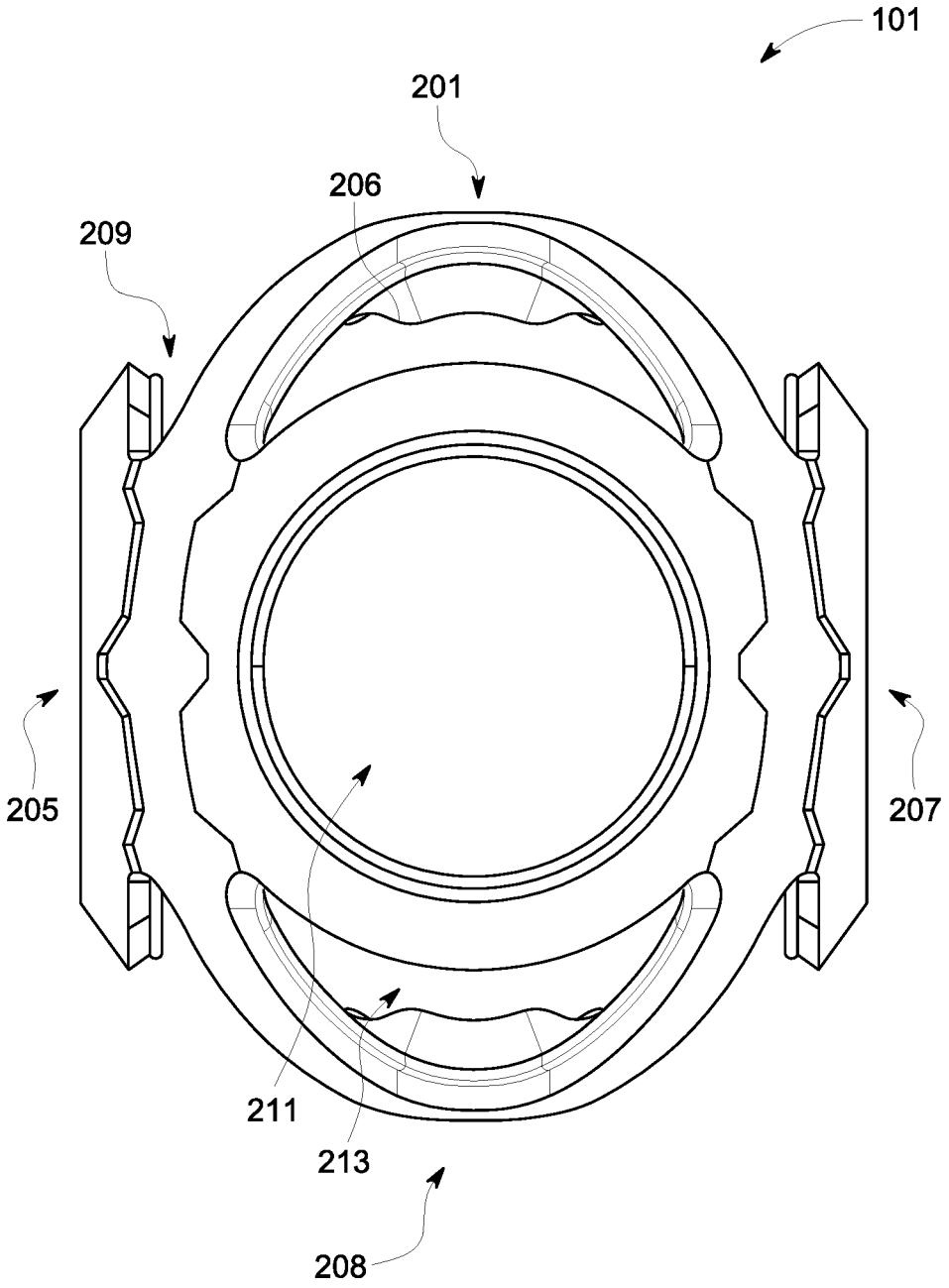
FIG. 2 is a first end view of the ball of FIG. 1.

As best shown in FIG. 2, the ball 101 further includes one or more substantially flat ends 205, 207 and one or more substantially curved ends 201, 208. The ball 101 having a plurality of openings 213 extending into an interior area 211. In some embodiments, the plurality of shaped components are attached such that one or more lips 209 are formed, thereby forming a gripping location for the user. Further, as shown, one or more interior lips 206 can extend inwardly to further provide for gripping locations for the user.

In FIG. 3, the ball 101 is shown in the configuration wherein two spherical paths 104, 106 are formed which follow the circumference of the ball. This allows the user to maximize roll along these paths.

Figure 4:
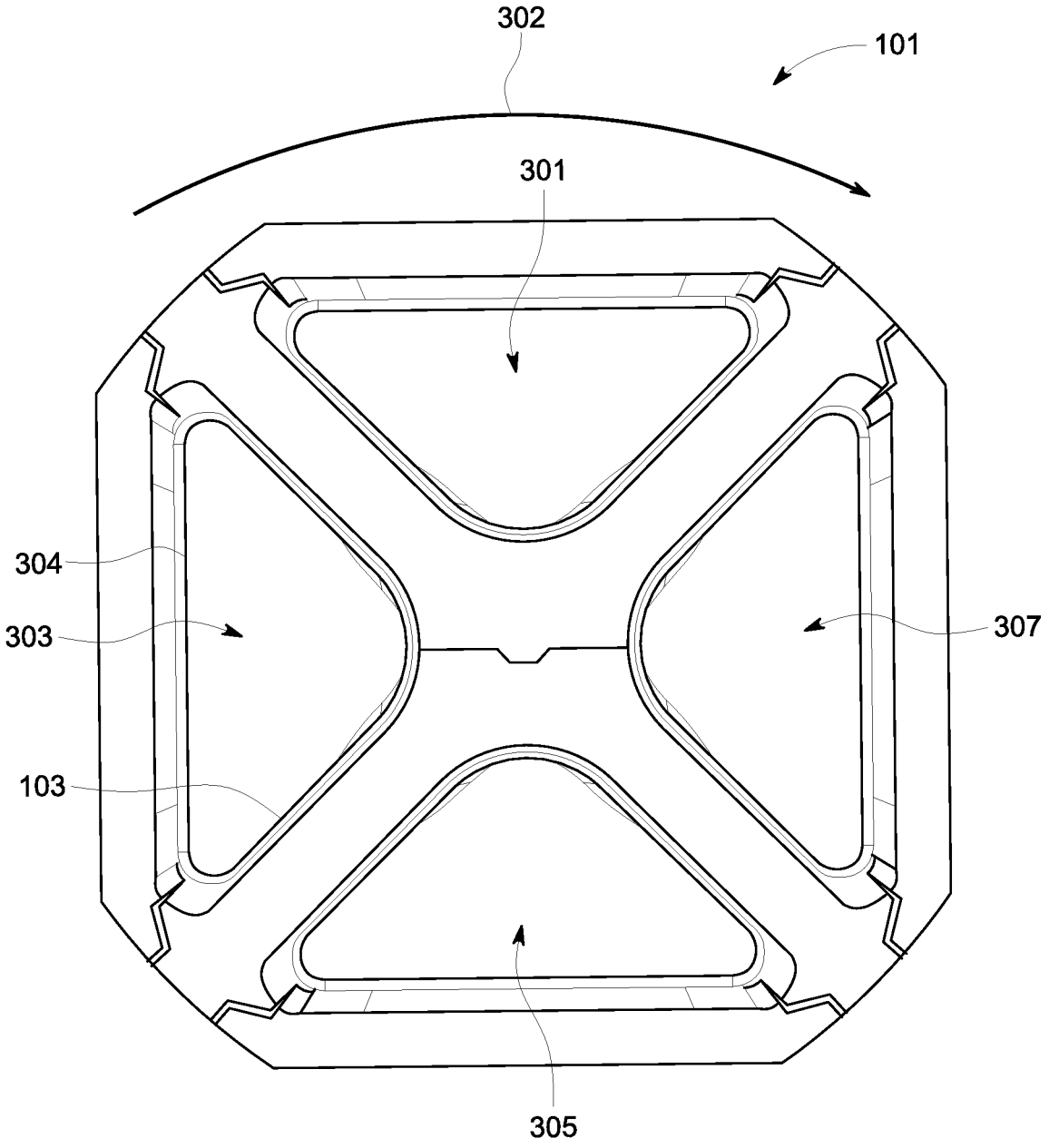
FIG. 4 is a third end view of the ball of FIG. 1.

As best shown in FIG. 4, the ball 101 can further include a plurality of triangular openings 301, 303, 305, 307 that extend into the interior area, further providing for a gripping location for the user. In some embodiments, one or more pieces of grip tape 304 are attached within the interior area of the ball, thereby further allowing for improved user grip. It should also be appreciated that the variously shaped openings allow for the user to grip as desired, such as with their entire hand, one or more fingers, or the like.

It should be appreciated that one of the unique features believed characteristic of the present application is the configuration of the ball that allows for the user to have multiple gripping locations, and the inclusion of both a cylindrical edge and a cube edge, wherein the cylindrical edge enhances rolling and the cube edge limits the rolling ability of the ball.

Figure 5:
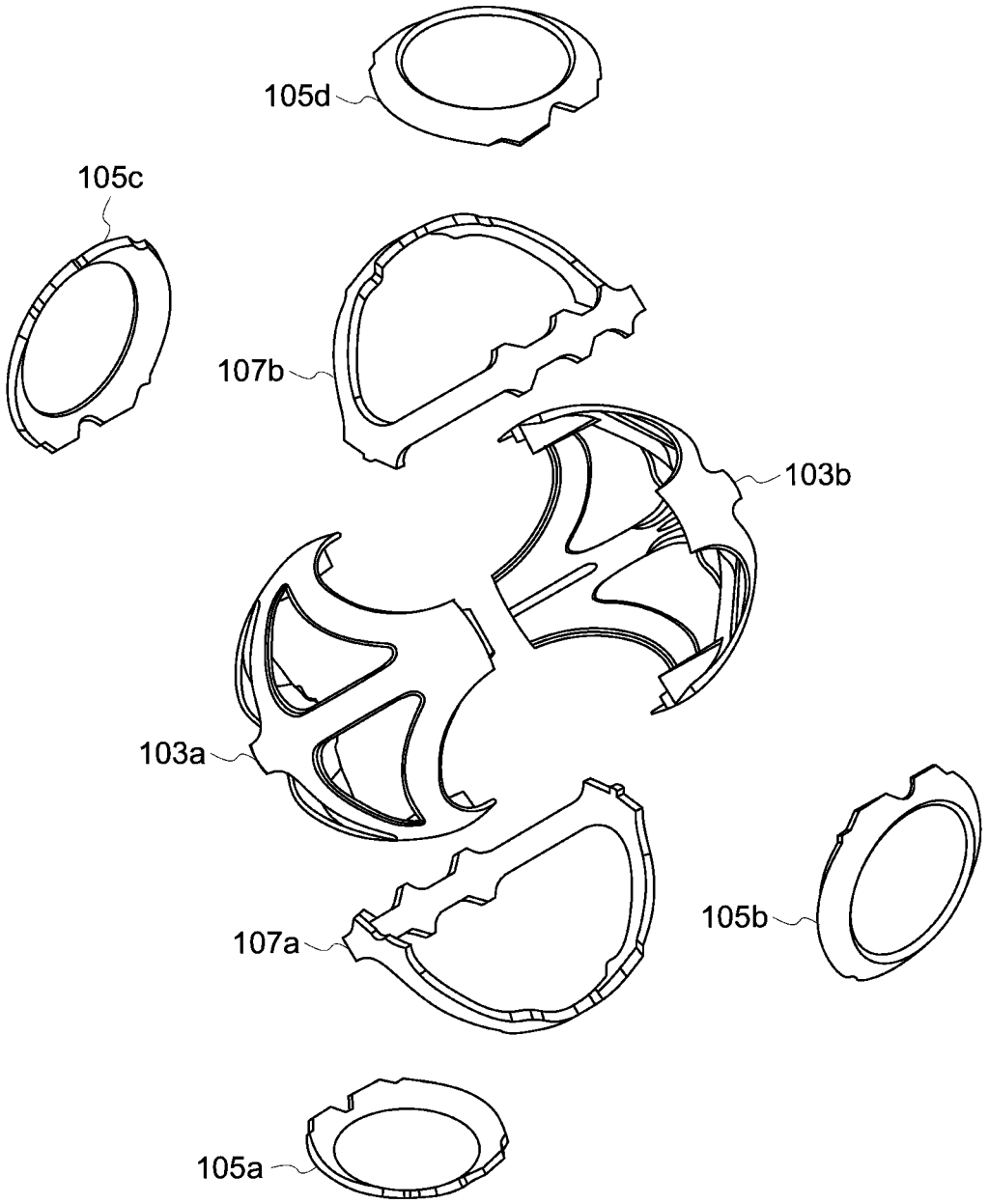
FIG. 5 is a disassembled view of the ball of FIG. 1.

In FIG. 5, a disassembled view of the ball is shown, wherein the ball includes four components 105*a-d*, two components 103*a-b*, and two components 107*a-b*. It should be appreciated that components 103*a-b* are interior structures of the ball. The remaining components 105*a-d*, 107*a-b* are soft pads to be attached to the exterior of the interior components 103*a-b*, as shown in FIGS. 1-4. It should be appreciated that the ball can function without the exterior pads.

Figure 6A:
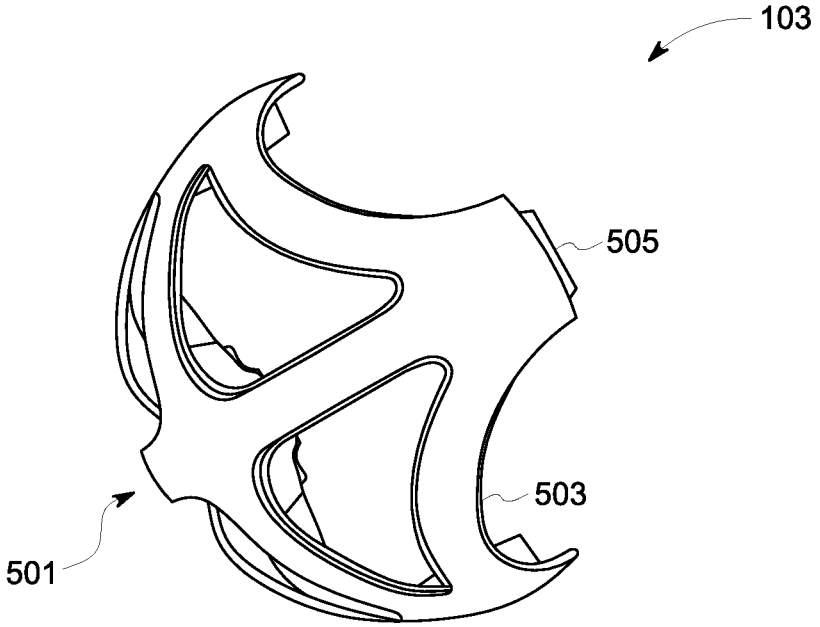
FIGS. 6A and 6B are isometric and front views of a first shaped component of the ball of FIG. 1.
Figure 6B:
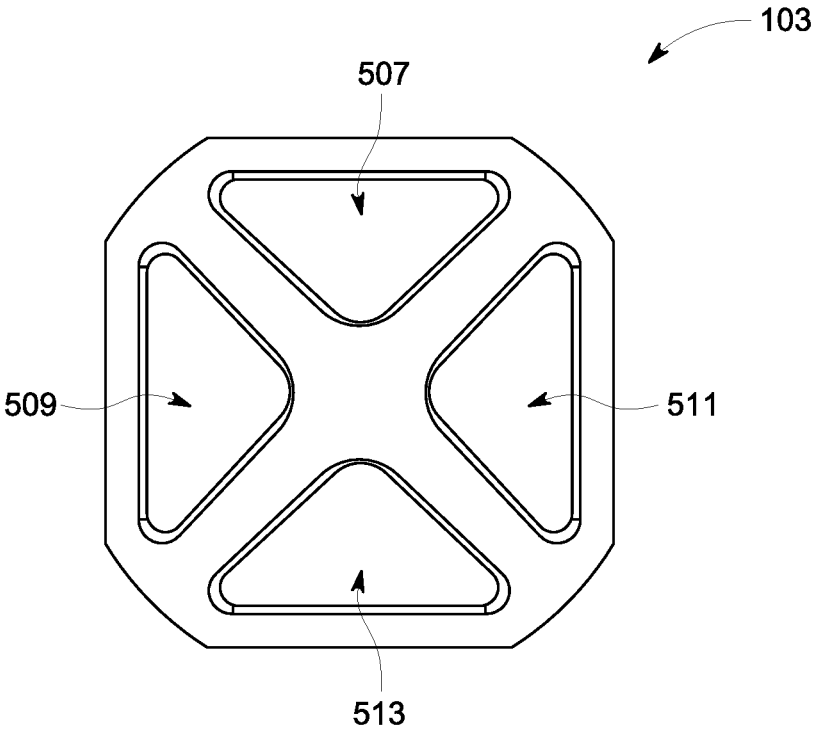

In FIGS. 6A and 6B, the first shaped component 103 (the inner scaffold) is shown. As shown, component 103 includes a first end 501 which curves down to a plurality of concave cutouts 503, wherein the plurality of concave cutouts 503 end in one or more tabs 505, the tabs 505 configured to secure to the other components to form a ball. As further shown, component 103 includes triangular openings 507, 509, 511, 513.

Figure 7A:
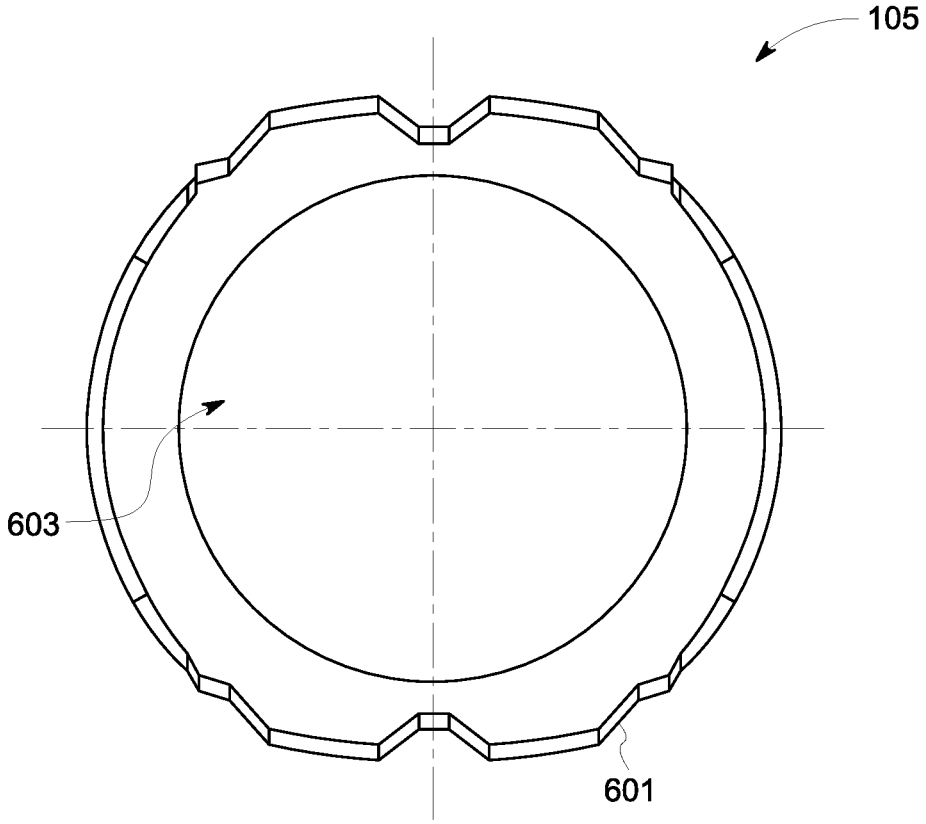
FIGS. 7A and 7B are end and side views of a second shaped component of the ball of FIG. 1.
Figure 7B:
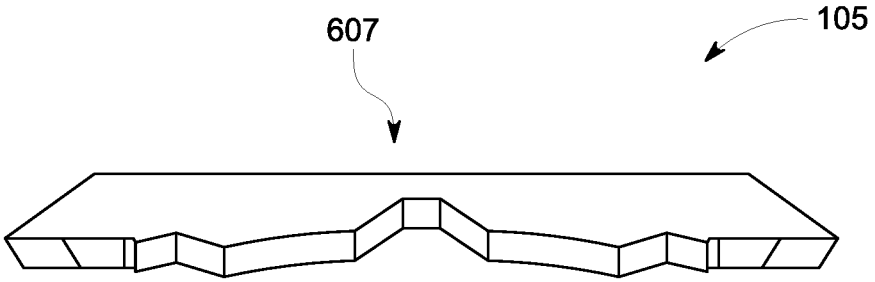

In FIGS. 7A and 7B, the second shaped component 105 (exterior pads) is shown. Component 105 includes a circular opening 603 and one or more tabs 601 that aid in securing component 105 to the plurality of other components. As further shown, component 105 includes a flat top 607.

Figure 8A:
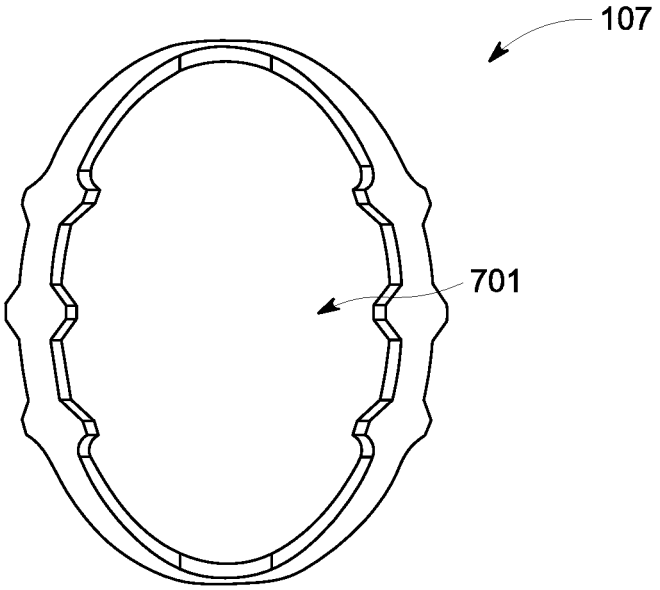
FIGS. 8A, 8B, and 8C are top and side views of a third shaped component of the ball of FIG. 1.
Figure 8B:
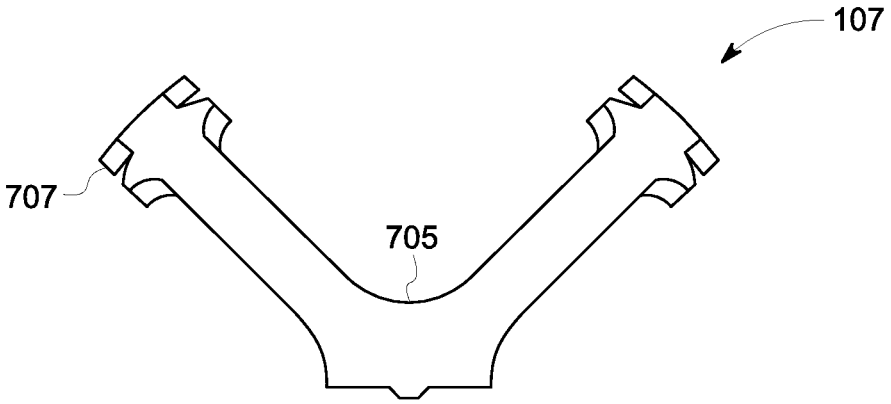
Figure 8C:
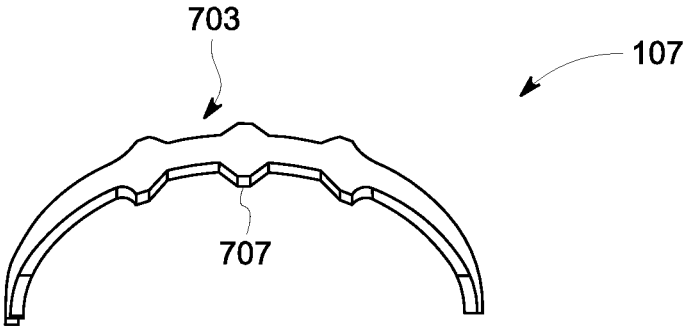

In FIGS. 8A and 8B, the third shaped component 107 (exterior pads) is shown, having a substantially oval opening 701. This component 107 is further in a V-shape, having a lower portion 705 that extends upward to one or more tabs 707 and grooves 703.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A non-spherical ball, comprising:

a plurality of shaped components secured together and forming a body of the non-spherical ball;

a cylindrical exterior extending around a first axis of the body;

a substantially cube exterior shape extending around a second axis of the body;

two inner scaffold components having triangular shaped openings and configured to secure together to form the ball; and one or more tabs configured to secure the two inner scaffold components together;

wherein the cylindrical exterior and the substantially cube exterior shape intersect at a right angle; and wherein the substantially cube exterior shape minimizes roll of the non-spherical ball when thrown on the second axis; and wherein the cylindrical exterior maximizes roll of the non-spherical ball when thrown on the first axis.

2. The ball of claim 1, wherein the plurality of shaped components comprises:

two exterior pads having a circular opening extending therethrough; and four exterior pads having a V-shaped body with an oval opening extending therethrough;

wherein the two exterior pads and the four exterior pads are configured to secure to the two inner scaffold components.

3. The ball of claim 1, wherein the body has a plurality of openings extending into an interior area.

4. The ball of claim 1, wherein the body further comprises: one or more lips configured to provide user grip.

5. The ball of claim 1, further comprising:

one or more openings extending into an interior area of the ball; and one or more pieces of grip tape attached to the body within the interior area and configured to provide user grip.

6. The ball of claim 1, further comprising:

one or more openings extending into an interior area of the ball; and one or more interior lips extending into the interior area and configured to provide user grip.

* * * * *